United States Patent [19]

Vanderpyl et al.

[11] Patent Number: 4,628,681

[45] Date of Patent: Dec. 16, 1986

[54] CABLING MACHINE

[75] Inventors: David C. Vanderpyl, Kingston; Albert C. Rogler, North Situate, both of R.I.

[73] Assignee: Mossberg Industries, Inc., Cumberland, R.I.

[21] Appl. No.: 794,169

[22] Filed: Nov. 1, 1985

[51] Int. Cl.[4] ..... D07B 3/06

[52] U.S. Cl. ..... 57/59; 57/13; 57/62; 57/64; 57/65

[58] Field of Search ..... 57/3, 6, 13–15, 57/59–65, 102, 103

[56] References Cited

U.S. PATENT DOCUMENTS

| | | | |
|---|---|---|---|
| 3,319,412 | 5/1967 | Winter et al. | 57/59 |
| 4,112,660 | 9/1978 | Ferrentino et al. | 57/61 X |
| 4,407,116 | 10/1983 | Henrich | 57/13 |
| 4,519,197 | 5/1985 | Borroni | 57/64 |
| 4,520,622 | 6/1985 | Ziemek et al. | 57/59 |
| 4,549,391 | 10/1985 | Toda et al. | 57/59 X |

*Primary Examiner*—John Petrakes

*Attorney, Agent, or Firm*—Blodgett & Blodgett

[57] ABSTRACT

Cabling machine for fine strands, in which the strands feed from cans that are arranged in a circle about the axis of a rotary table, each can taking part in one rotation about its axis for each rotation of the table.

3 Claims, 7 Drawing Figures

Fig. 6
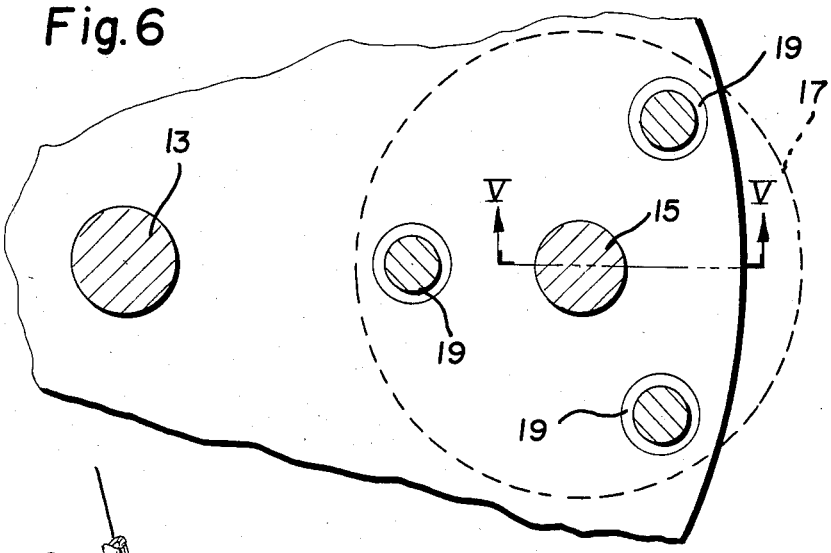
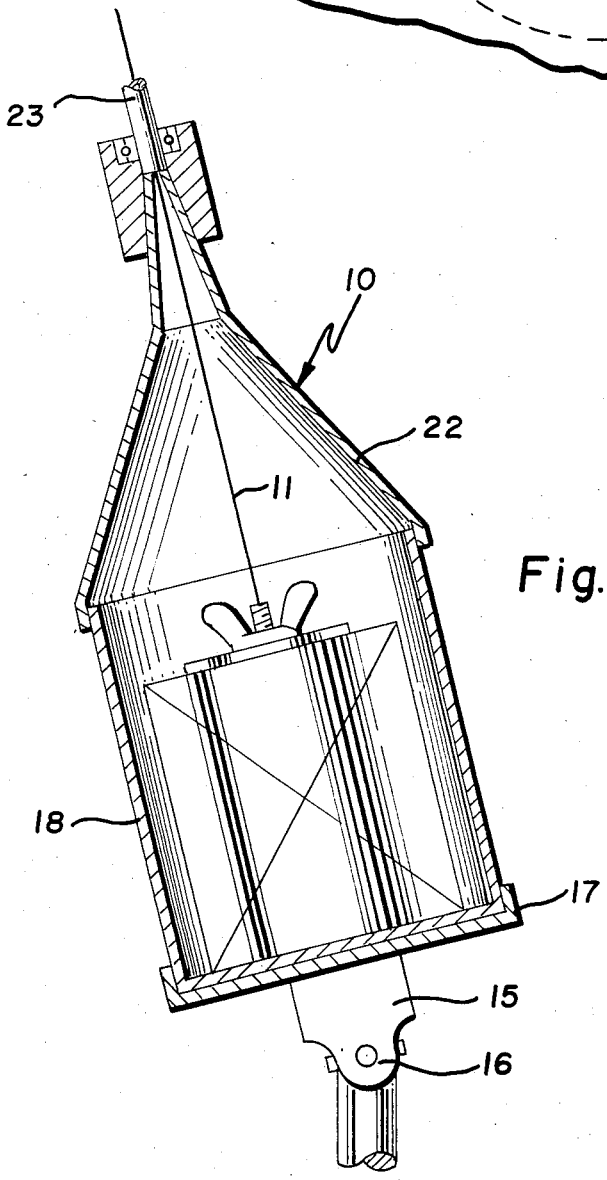
Fig. 7

CABLING MACHINE

BACKGROUND OF THE INVENTION

In the art of the manufacturing cable by twisting strands, it is common practice to rotate reels on which strands are coiled about an axis on which the cable is to be formed. In the past, each strand left its reel under substantial tension and passed over guide pulleys on its way to the point at which the strands were gathered into the cable.

While this system is satisfactory for strong materials, it does not work well for fragile strands, such as optical fibre. In order to maintain the structual integrity of the glass fibre, it is necessary that it not be subjected to tension and sharp bending. These and other difficulties experienced with the prior art machines have been obviated in a novel way by the present invention.

It is, therefore, an outstanding object of the invention to provide a cabling machine for fragile strands in which the strand is not subjected to tension and sharp bending.

Another object of this invention is the provision of a cabling machine in which the strands are fed from cans without twist.

A further object of the present invention is the provision of a cabler for optical strands in which the strands are not subjected to air stream interference.

It is another object of the instant invention to provide a cabler for delicate strands, which machine lacks pulley-type guides for the strands.

A still further object of the invention is the provision of a cabler in which the helix angle of the cable strands can be readily adjusted.

With these and other objects in view, as will be apparent to those skilled in the art, the invention resides in the combination of parts set forth in the specification and covered by the claims appended hereto.

SUMMARY OF THE INVENTION

In general, the invention relates to a cabling machine for use with delicate strands, wherein the axis of cable orientation is vertical, the strands are gravity-tensioned, and the strands are fed from reel-less packaging in cylindrical open-top containers. In addition, a conical enclosure is provided for each strand to prevent air stream interference at high rotational speeds.

More specifically, inclined holders are provided for the containers and they are always aimed at the closing point of the strands, despite the fact that each container is rotating about its own axis, while the machine's rotor assembly revolves around its axis, three ball casters being used for this purpose.

Guide sheaves are eliminated and the inclined angle of the strands may be adjusted to suit the desired helix angle of the cable. The planetary motion is achieved by an eccentric ring and cranks.

BRIEF DESCRIPTION OF THE DRAWINGS

The character of the invention, however, may be best understood by reference to one of its structural forms, as illustrated by the accompanying drawings, in which:

FIG. 6 is a horizontal sectional view of the machine taken on the line VI—VI of FIG. 3, and FIG. 7 is a generally vertical sectional view of the machine taken on the line VII—VII of FIG. 3.

DESCRIPTION OF THE PREFERRED EMBODIMENT

Figure 1:
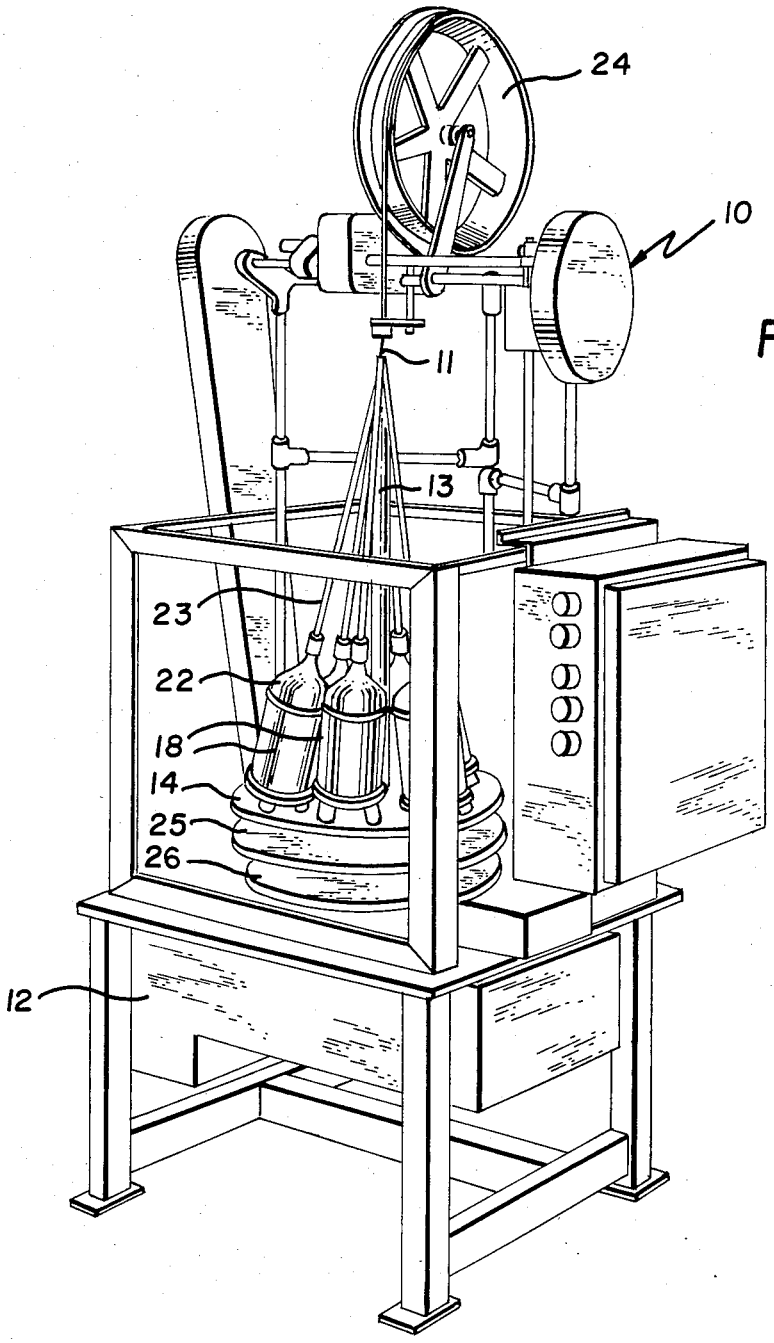
FIG. 1 is a perspective view of a cabling machine incorporating the principles of the present invention.

Referring first to FIG. 1, wherein are best shown the general features of the invention, the cabling machine, indicated generally by the reference numeral 10, is shown as intended to form a number of fine strands 11 into a cable by twisting them together. A vertical main drive spindle 13 is rotatably mounted on a base 12 and driven by an electric motor (not shown) mounted on the base.

Figure 2:
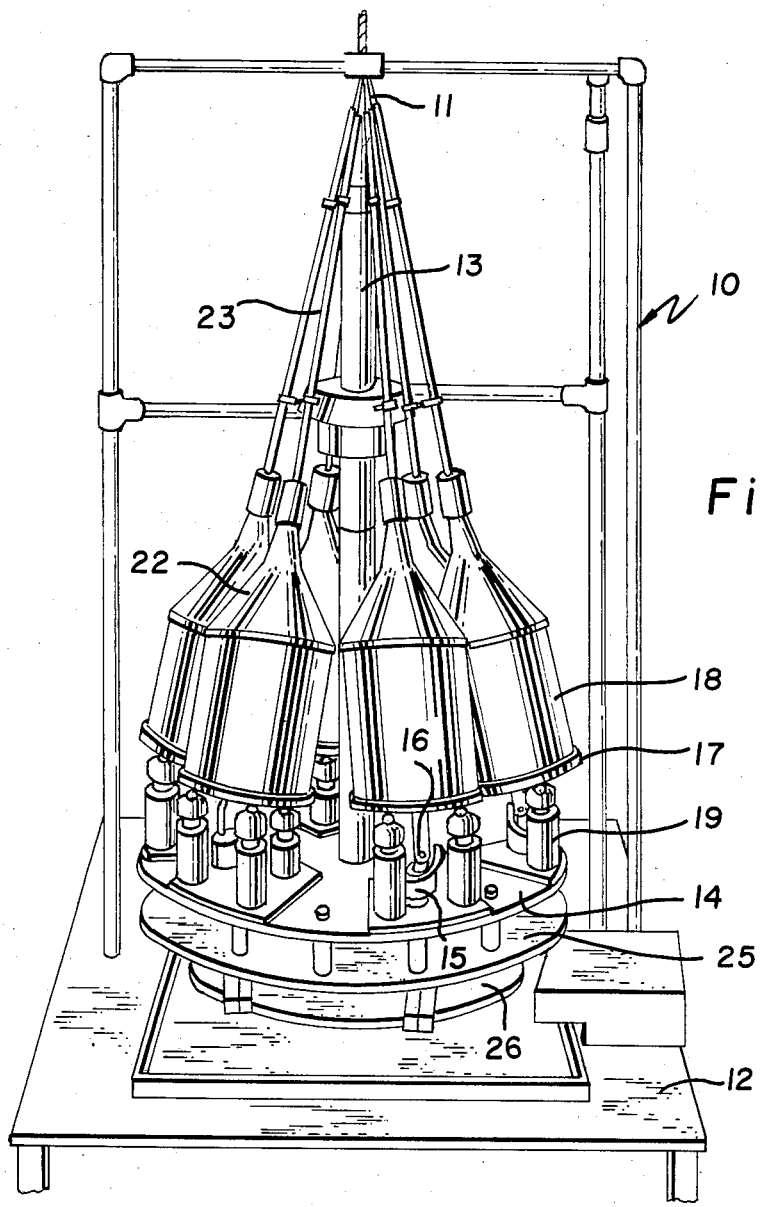
FIG. 2 is a front elevational view of the machine.

As is evident in FIG. 2, a disk-like horizontal table 14 is carried by the spindle and is rotatable therewith. A plurality of vertical shafts 15 are rotatably carried by the table and arranged in a circle which is concentric with the spindle 13, Each shaft including a universal joint 16. A platen 17 is carried on the upper end of each shaft; each platen is adapted to carry an open-mouthed container 18 packaged with strand 11 coiled in the well-known manner to feed from the upper end.

Figure 3:
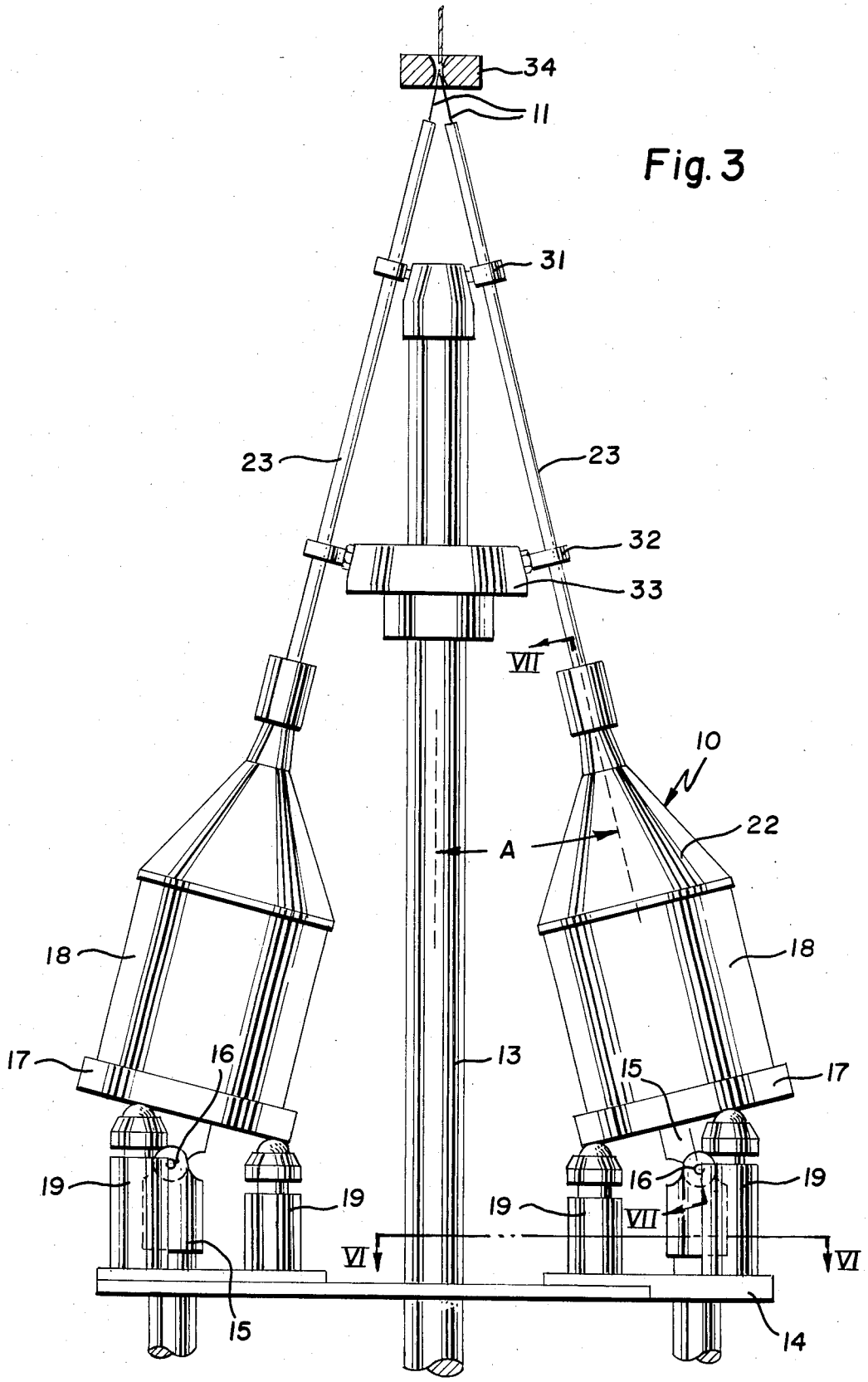
FIG. 3 is an enlarged front elevational view of a portion of the machine.

In FIG. 3, it can be seen that a set of three anti-friction pillars 19 are carried by the table under each platen 17 to support and hold the platen at a preselected angle A to the axis of the spindle 13. A differential means 21 joins the spindle 13 to the shafts 15, so that each platen 17 rotates once about the axis of its shaft during each rotation of the spindle.

A cone-shaped funnel 22 extends upwardly from the upper end of each container and elongated tubular guides 23 extend from the upper ends of the funnels to the upper end of the spindle toward a gathering point where the cable is formed and passes onto a large pulley (FIG. 1) mounted at the top of the machine.

FIG. 6 shows the arrangement of the pillars 19 around the shaft 15 and their relationship to the main drive spindle 13. The two outer pillars lie on opposite sides of the radial line joining the axes of the spindle 13, the inner pillar, and the shaft 15.

Figure 4:
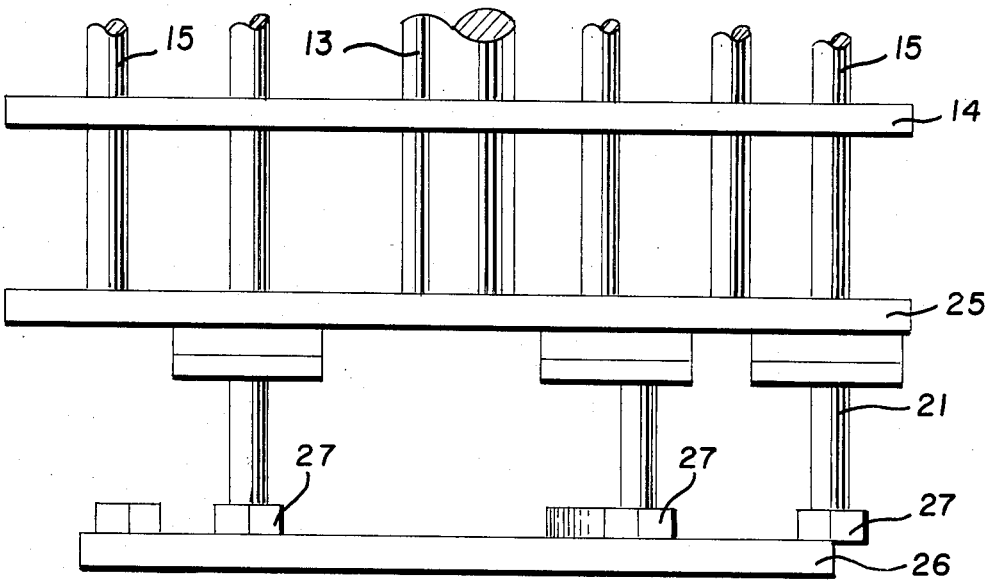
FIG. 4 is an enlarged front elevational view of another portion of the machine.
Figure 5:
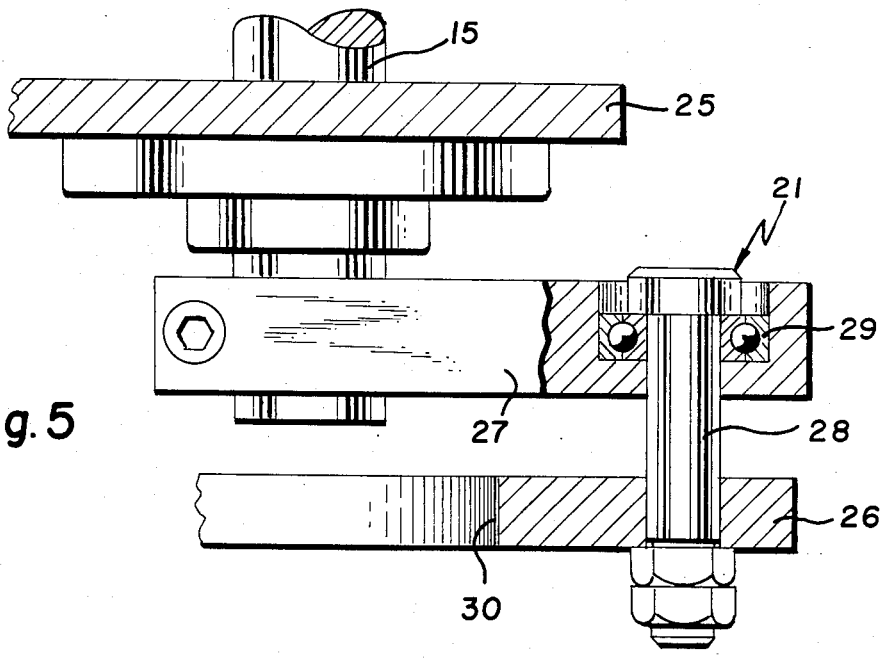
FIG. 5 is a vertical sectional view of the machine taken on the line V—V of FIG. 6.

The differential means 21 is shown in FIGS. 4 and 5 and includes the table 14 which rotates with the spindle 13 and a lower table 25 which also moves with it. The shafts 15 extend through and are rotatable in the two upper tables.

An annular ring 26 is arranged under the table 25, is spaced from, and is parallel to it. The ring is mounted to be independently movable relative to the spindle 13 and the tables 14 and 25. As is best evident in FIG. 5, each shaft 15 extends downwardly through the table 25 and is fixed to one end of a horizontal crank 27. A vertical post 28 extends upwardly from the periphery of the ring 26 and rides in a bearing 29 mounted in the other end of the crank.

The ring floats in a horizontal plane and is restrained by two rollers (not shown). These rollers are mounted on the base 12 and rotate about vertical axes. They are located on diametrically opposite sides of the spindle. The ring, therefore, surrounds the spindle and the rollers; it has an inner cylindrical surface 30 that engages the rollers. They serve to hold the ring in a position in which it is eccentric with the spindle. The cranks 27 connect the ring 26 to the shafts 15 to rotate each shaft and its platen in reverse through 360° during each rotation of the cable.

FIG. 7 makes it evident that the platen 17 and its container 18 not only rotate around the main spindle 13, but that they also rotate about their own axes, as determined by the shaft 15. This differential reverse motion causes the same spot on the container 18 to face the spindle 13 at all times. The net effect is that the strand 11 leaves the container without a twist, which is important in the formation of the cable, particularly when a brittle, delicate strand is being used. The fact that the lightweight strand lies within the funnel 22 means that the air current generated by rotation about the spindle 13 does not act on the strand and cause deleterious effects.

It should be noted that the guide 23 in FIG. 3 is supported at the upper end by a universal ring 31 in the nature of the well-known ball-and-socket arrangement known as a "male rod end" and manufactured by SEALMASTER. The lower end of the guide 23 is supported in a similar universal ring 32; this last ring, however, is mounted on a hub 33 which can be slidably adjusted lengthwise of the spindle 13. This construction, combined with adjustable height of the pillars 19 (LANGLEY castor ball Model 5BT-1), permits selection of the strand angle, while maintaining the strand in a straight line from the container to the gathering die 34.

It is obvious that minor changes may be made in the form and construction of the invention without departing from the material spirit thereof. It is not, however, desired to confine the invention to the exact form herein shown and described, but is is desired to include all such as properly come within the scope claimed.

The invention having been thus described, what is claimed as new and desired to secure by Letters Patent is:

1. Cabling machine for a plurality of fine strands, comprising (a) a fixed base, (b) a motor-driven vertical rotatable spindle, (c) a disk like table extending horizontally from the spindle, (d) a plurality of vertical shafts carried by the table with their axes concentric of the spindle, each shaft including a universal joint, (e) a platen mounted on the upper end of each shaft, each platen being formed to carry an open-mouthed container of strand, (f) a set of anti-friction pillars mounted on the table under each platen to hold the platen at all times at a preselected angle to the axis of the spindle, and (g) differential means joining the spindle to the shafts, so that each platen rotates once about the axis of its shaft during each rotation of the spindle.

2. Cabling machine as recited in claim 1, wherein a cone-shaped funnel extends upwardly from the upper end of each container, and wherein an elongated tubular guide extends from the upper end of the spindle toward the upper ends of each funnel.

3. Cabling machine as recited in claim 1, wherein the differential means consists of two rollers with vertical axes mounted on the base and located on diametrically opposite sides of the spindle, wherein a ring surrounds the spindle and the rollers, the ring having an inner cylindrical surface that engages the rollers, the rollers being located so that they hold the ring in a position in which it is eccentric to the spindle, and wherein cranks connect the ring to the shafts to rotate each shaft and its platen in reverse through 360° during each rotation of the table.

* * * * *